US007493711B2

(12) United States Patent
Gautreau et al.

(10) Patent No.: US 7,493,711 B2
(45) Date of Patent: Feb. 24, 2009

(54) RIDE-ON SNOW BLOWER

(76) Inventors: Ronald Michael Gautreau, 22 chestnut cres., Moncton, New Brunswick (CA) E1G2S4; Uclise Joseph LeBlanc, 88 chartersville road, Dieppe, New Brunswick (CA) E1G2S4

( * ) Notice: Subject to any disclaimer, the term of this patent is extended or adjusted under 35 U.S.C. 154(b) by 193 days.

(21) Appl. No.: 11/408,627

(22) Filed: Apr. 22, 2006

(65) Prior Publication Data

US 2006/0236565 A1 Oct. 26, 2006

Related U.S. Application Data

(60) Provisional application No. 60/674,664, filed on Apr. 26, 2005.

(51) Int. Cl.
*E01H 5/09* (2006.01)
*B62D 63/00* (2006.01)

(52) U.S. Cl. ..... 37/249; 37/268; 280/32.7; 296/102

(58) Field of Classification Search ..... 37/246, 37/262, 254, 257, 261, 260, 249; 56/14.9, 56/14.3, 15.7; 296/102, 79, 77.1
See application file for complete search history.

(56) References Cited

U.S. PATENT DOCUMENTS

| | | | | | |
|---|---|---|---|---|---|
| 804,702 | A * | 11/1905 | Bloom | 280/32.7 |
| 2,218,064 | A * | 10/1940 | Amsbury | 280/32.7 |
| 2,740,462 | A * | 4/1956 | Stegeman | 280/32.7 |
| 2,855,060 | A * | 10/1958 | Colburn | 180/11 |
| 2,919,756 | A * | 1/1960 | Knipe | 180/11 |
| 3,190,672 | A * | 6/1965 | Swanson et al. | 280/32.7 |
| 3,333,888 | A * | 8/1967 | Williams et al. | 296/102 |
| 3,742,685 | A * | 7/1973 | Lian et al. | 56/7 |
| 4,013,315 | A * | 3/1977 | West | 296/83 |
| 4,192,525 | A * | 3/1980 | Clark | 280/443 |
| 4,372,602 | A * | 2/1983 | Tsuchiya et al. | 296/77.1 |
| 4,433,868 | A * | 2/1984 | Hochwitz et al. | 296/79 |
| 4,487,006 | A * | 12/1984 | Scag | 56/14.7 |
| 4,532,725 | A * | 8/1985 | Trejo et al. | 37/243 |
| 4,663,923 | A * | 5/1987 | Boice | 56/15.8 |
| 4,773,694 | A * | 9/1988 | Gerber | 296/77.1 |
| 4,989,351 | A * | 2/1991 | Shear | 37/242 |
| 4,998,948 | A * | 3/1991 | Osterling | 56/12.6 |
| 5,033,564 | A * | 7/1991 | Mattson | 180/11 |
| 5,052,135 | A * | 10/1991 | Fontaine | 37/243 |
| 5,388,850 | A * | 2/1995 | Simone | 280/442 |
| 5,463,853 | A * | 11/1995 | Santoli et al. | 56/6 |
| 5,564,721 | A * | 10/1996 | Wians | 280/32.7 |
| 5,718,534 | A * | 2/1998 | Neuling | 404/94 |
| 5,813,679 | A * | 9/1998 | Hobrath | 280/32.7 |
| 5,842,707 | A * | 12/1998 | Smith | 280/32.7 |
| 5,890,507 | A * | 4/1999 | Hinsperger | 135/96 |
| 6,499,238 | B2 * | 12/2002 | Kluck et al. | 37/261 |
| 6,530,617 | B2 * | 3/2003 | McElwee et al. | 296/77.1 |
| 6,564,481 | B2 * | 5/2003 | Wakitani et al. | 37/348 |

(Continued)

*Primary Examiner*—Thomas A Beach

(57) ABSTRACT

A ride-on snow blower is described that includes a cab for housing and protecting a rider of the snow blower from the elements, a seat, a door, cab windows, a front frame section, an adjustable snow chute operable for flexible snow disposal, a motor, a motor powered auger for transporting snow to the snow chute, rear wheels located generally under the seat, front wheels located in general proximity to the motor, rear wheel steering mechanisms, drive mechanisms for locomotion of the snow blower in a desired direction, and a power source to power electrical components of the snow blower.

16 Claims, 4 Drawing Sheets

U.S. PATENT DOCUMENTS 6,662,477 B2 * 12/2003 Dowe et al. ..... 37/257
6,688,090 B2 * 2/2004 Velke et al. ..... 56/14.7
6,832,884 B2 * 12/2004 Robinson ..... 414/539
6,874,796 B2 * 4/2005 Mercurio ..... 280/32.7
6,986,397 B2 * 1/2006 Mattson et al. ..... 180/11
7,066,526 B2 * 6/2006 Weddington et al. ..... 296/105
7,093,380 B2 * 8/2006 Hubscher et al. ..... 37/231
7,213,864 B2 * 5/2007 Gasper ..... 296/83
7,216,926 B2 * 5/2007 Hampel ..... 296/190.08
2005/0050774 A1 * 3/2005 Cadman ..... 37/266

* cited by examiner

DRIVE PEDAL DETAIL

RIDE-ON SNOW BLOWER

CROSS-REFERENCE TO RELATED APPLICATIONS

The present Utility patent application claims priority benefit of the U.S. provisional application for patent No. 60/674,664 filed on Apr. 26, 2005 under 35 U.S.C. 119(e). The contents of this related provisional application are incorporated herein by reference.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to snow removal means. More particularly, the invention relates to a snow-blowing machine that can be ridden by the operator.

BACKGROUND OF THE INVENTION

Traditional means for the removal of snow include, without limitation, walk-behind snow blowers and shoveling. These methods are work intensive and can be very time consuming. Also, with walk-behind snow blowers, there is the risk that the operator may be injured by flying debris from the snow blower or may obtain other injuries such as, but not limited to, back injuries, exposure to harsh weather, and slipping and falling.

Another known method for snow removal is to use a garden tractor with a snow blower attachment. However, a garden tractor with a snow blower attachment may be hard to maneuver, and is difficult to turn in tight areas.

In view of the foregoing, there is a need for an improved means of snow removal that is less work intensive, reduces the risk of injury to the operator, and is easy to maneuver, even in tight areas.

BRIEF DESCRIPTION OF THE DRAWINGS

The present invention is illustrated by way of example, and not by way of limitation, in the figures of the accompanying drawings and in which like reference numerals refer to similar elements and in which:

FIG. 5A shows a top view, and FIG. 5B shows a rear view;

Figure 1:
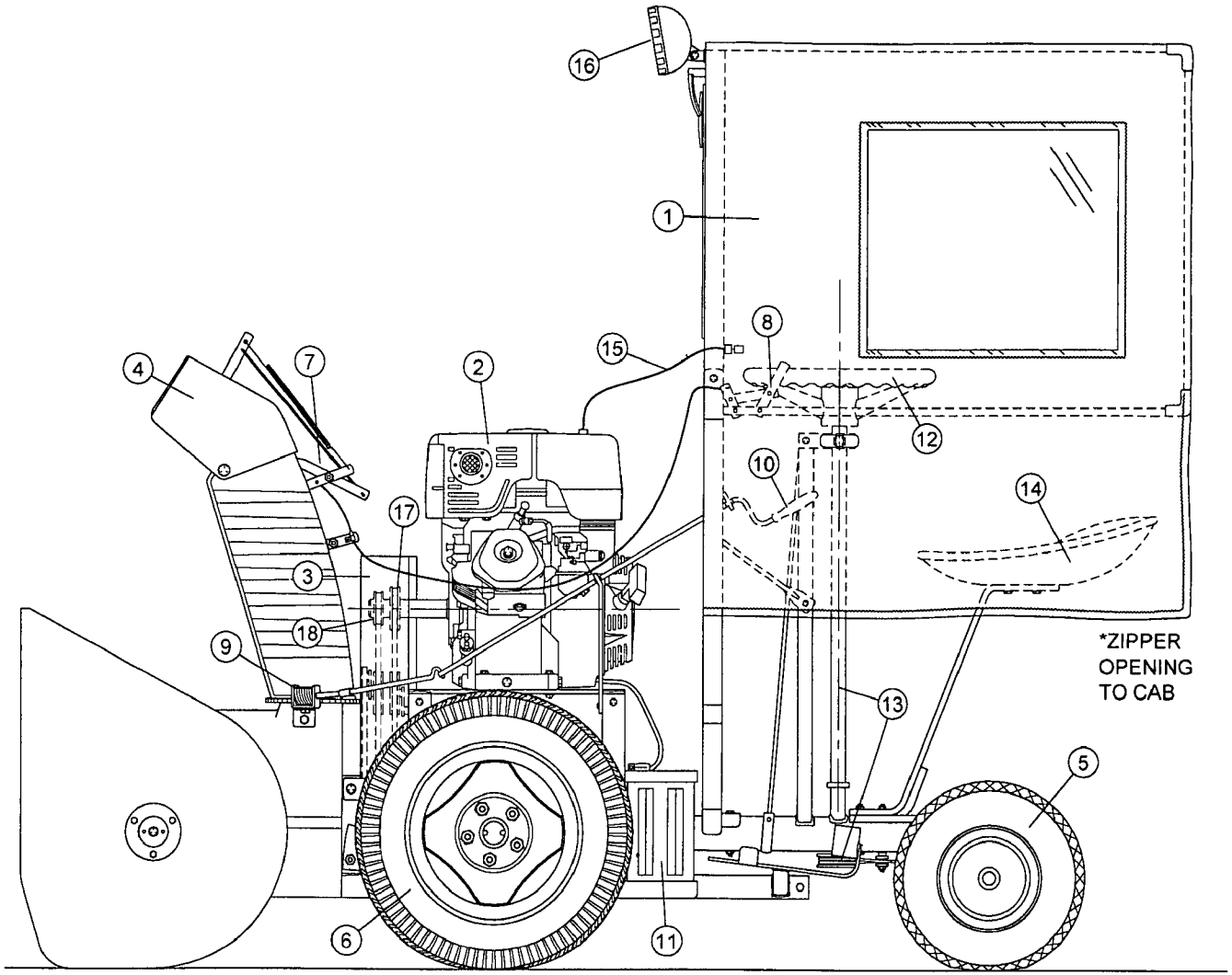
FIG. 1 shows a side view of an exemplary ride-on snow blower, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a ride-in snow blower apparatus is described.

A ride-on snow blower apparatus is provided that, in one embodiment, includes a cab means for housing and protecting a rider of the snow blower from the elements, means for the rider to sit down in the cab means, means for gaining access to the cab means, means for to view outside the cab means from inside, means configured with the cab means for protecting the rider from injury and for providing a sturdy mounting location for electrical accessory equipment, a snow chute operable for flexible snow disposal, the snow chute having an adjustable pitch and orientation, a motor, means for controlling the power output of the motor, means in corporation with the motor for transporting snow to the snow chute, means for controllably powering and lifting the snow transporting means, rear wheels located generally under the sitting means, the rear wheels being supported by at least one axle structurally joined to a frame of the snow blower, front wheels located in general proximity to the motor, means for steering the snow blower in a desired direction, means in corporation with the motor for controllably powering the locomotion of the snow blower in the desired direction, and a power source to power electrical components of the snow blower.

Preferred embodiments of the present invention may also include any combination of a including means for adjusting the pitch and/or orientation of the snow chute, and/or means for protect surrounding equipment from interfering with drive pulleys of the snow blower, and/or means for enabling differential axle action in the snow blower thereby facilitating smooth operation of the snow blow without shifting, and/or means for enabling the at least one rear axle to pivot around the center point of the at least one rear axle to thereby improve smooth operation on rough or wavy terrain, and/or means for keeping the snow transporting means from hindering normal driving operation of the snow blower when the snow transporting means is not being used.

In yet other embodiments of the present invention, the rear wheels are disposed relatively close to the centerline of the snow blower and thereby being operable to enable easy turning and to stay out of snow during turns. In yet other embodiments the snow transporting means powering means comprises a hydrostatic trans-axle unit, which unit transmits movement to the front wheels through internal hydraulic motors that receive constant power input from the motor.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognized a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternatives embodiments do not necessarily imply that the two are mutually exclusive.

The present invention will now be described in detail with reference to embodiments thereof as illustrated in the accompanying drawings.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

FIG. 1 shows a side view of an exemplary ride-on snow blower, in accordance with an embodiment of the present invention. In the present embodiment, the snow blower includes, without limitation, a canvas weather cab 1 and a 13 HP motor 2. Cab 1 has a steel top and front and canvas sides and back. Cab 1 protects the operator from the weather and from debris that may be stirred up by the snow blower. In alternate embodiments cab 1 may be made of other materials such as, but not limited to various metals or hard plastics for the front and top and various durable fabrics or flexible plastic for the sides and back. In the present embodiment, a zipper allows easy access into and out of cab 1. In alternate embodiments, cab 1 may be opened and closed by other means such as, but not limited to, snaps, hook-and-loop tape, or overlapping flaps. Windows in cab 1 allow for a 360° view. In the present embodiment, these windows are glass in the front section of cab 1 and are transparent plastic in the canvas sections of cab 1. Cab 1 also serves as mounting point for headlights 16. The present embodiment has dual headlights 16 mounted to the top of cab 1 to provide lighting. In the present embodiment, motor 2 is a 13 HP horizontal shaft motor. Motor 2 has sufficient power to both drive the vehicle as well as an auger 19, shown by way of example in FIG. 2. A front output shaft of motor 2 allows for simple connection to drive pulleys and minimum drive train losses due to simplicity and a low number of parts. Motor 2 also acts a counter weight to help lift auger 19, as shown by way of example in FIG. 6.

In the present embodiment, a belt cover 3 protects surrounding equipment from getting tangled into the drive pulleys. Also, in the event of a belt failure, belt cover 3 contains the belt pieces. A snow chute 4 with an adjustable pitch and orientation is located behind auger 19, shown by way of example in FIG. 2. Snow chute 4 allows for flexible snow disposal. Rear wheels 5 are located under a seat 14. The tracks of rear wheels 5 are close to the centerline of the vehicle, which allows rear wheels 5 to stay out of snow during turns, and allows for easy turning because of their closeness to each other. Seat 14 is provided for the operator to sit on during operation. Front wheels 6 are located near motor 2. The drive of the vehicle is provided through front wheels 6. The weight of motor 2 and auger 19 increases the traction of front wheels 6. A chute pitch adjuster and cable 7 leads to a chute pitch control lever 8 inside of cab 1. Chute pitch control lever 8 allows for quick and easy adjustment of the pitch of snow chute 4 from within cab 1. The present embodiment also has a chute orientation adjuster 9 that leads to a chute orientation control lever 10 inside of cab 1. Chute orientation control lever 10 allows for quick and easy adjustment of the orientation of snow chute 4 from within cab 1.

Figure 2:
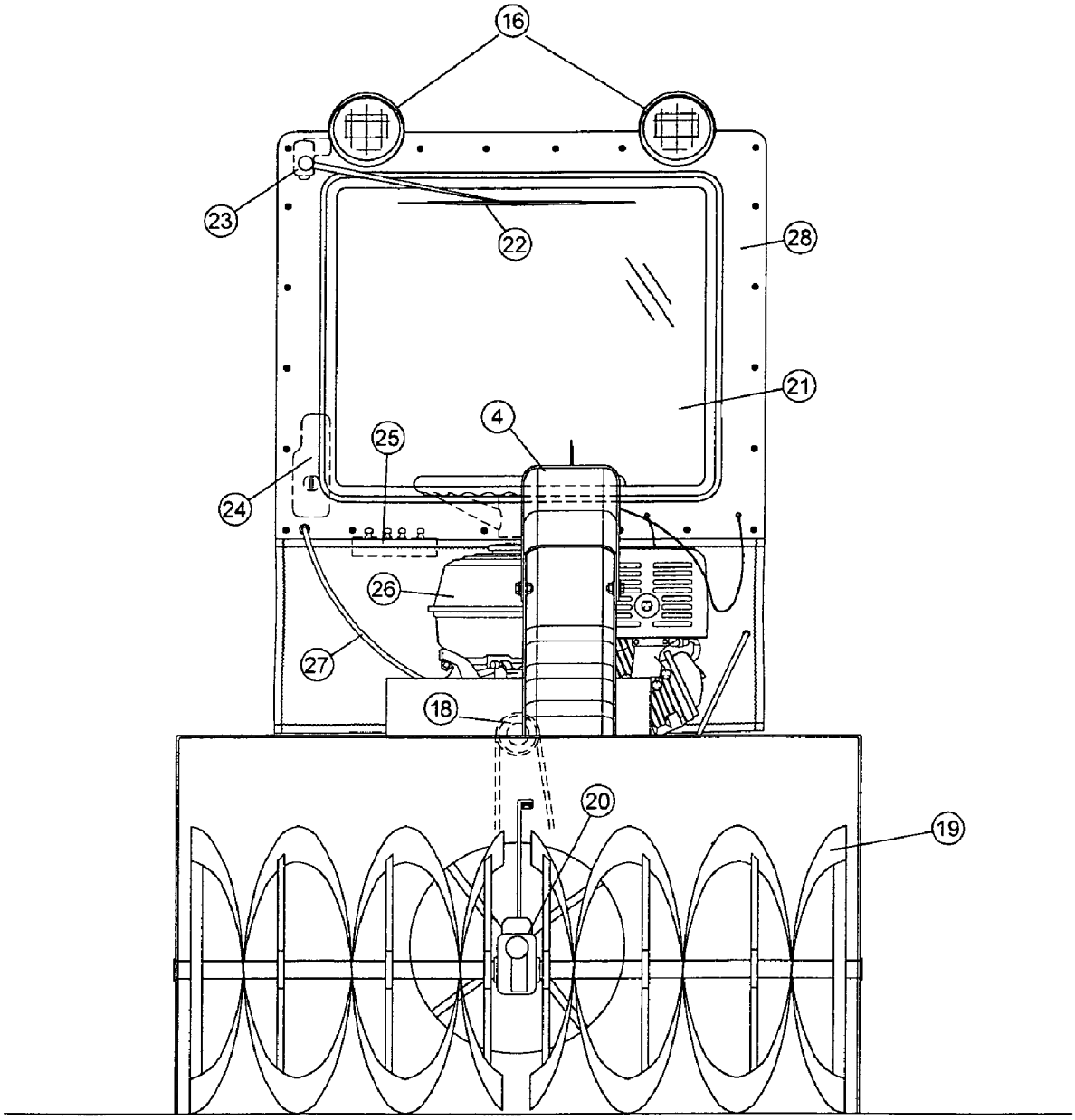
FIG. 2 shows a front view of an exemplary ride-on snow blower, in accordance with an embodiment of the present invention.

In the present embodiment, a 12V Battery 11 is provided to operate the electrical system, including, but not limited to, a starter, a windshield wiper 22, shown by way of example in FIG. 2, lights, including, but not limited to headlights 16, and other accessories. A steering wheel 12 is also provided, which is connected to a steering column and pulley system 13. Steering column and pulley system 13 is used to transmit proper movement to rear steering knuckles 42. A throttle control cable 15 and a lever allow for proper control of the RPM of motor 2; proper throttle depends on operational load. A hydrostatic trans-axle drive belt and pulley 17 is coupled with a tensionner. Hydrostatic trans-axle drive belt and pulley 17 transmit rotation from an output shaft of motor 2 to a hydrostatic trans-axle input shaft. The tensionner provides proper belt tension of hydrostatic trans-axle drive belt 17. The present embodiment also has an auger drive belt and pulley 18 coupled with a tensionner. Auger drive belt and pulley 18 transmit rotation from the output shaft of motor 2 to an auger input shaft, and the tensionner provides the proper belt tension.

FIG. 2 shows a front view of an exemplary ride-on snow blower, in accordance with an embodiment of the present invention. Auger 19 is a rotational assembly of blades which carries snow to snow chute 4. An auger drive gearbox 20 transmits rotational movement from the auger input shaft to auger 19, and rotation is transmitted from motor 2, shown by way of example in FIG. 1, to the auger input shaft through auger drive belt and pulley 18. The present embodiment has a glass windshield 21 that allows an unrestricted view ahead of the vehicle. In alternate embodiments windshield 21 may be made of other materials such as, but not limited to, clear plastic. The present embodiment includes, without limitation, windshield wiper 22, comprising an arm and a blade, that allows for quick and easy cleaning of windshield 21 while keeping the blade out of the operator's field of vision when not in use. Other embodiments may include, without limitation, no windshield wiper or multiple windshield wipers. In the present embodiment, a windshield wiper motor 23 is mounted high in the corner of cab 1 as to not impede operation of the vehicle or the vision of the operator. In alternate embodiments windshield wiper motor 23 may be mounted in various places for example, without limitation, in the top center of cab 1 or at the base of windshield 21.

In the present embodiment, an ignition control switch 24 is mounted in cab 1 to be protected from the weather. Light and wiper control switches 25 are also mounted in cab 1 on a control console to be protected from the weather. Light and wiper control switches 25 may operate various items such as, but not limited to, windshield wiper 22, headlights 16 and an internal light in cab 1. A wiring harness 27 holds the wiring associated with ignition control switch 24 and light and wiper control switches 25. A gas tank 26 is also provided. In the present embodiment cab 1 has a steel front section 28. Front section 28 is part of the structure of cab 1 and supports the top of cab 1 and protects the operator. Front section 28 also allows for easy mounting of wiper motor 23 and controls, such as, but not limited to, light and wiper control switches 25 and ignition switch 24.

Figure 3:
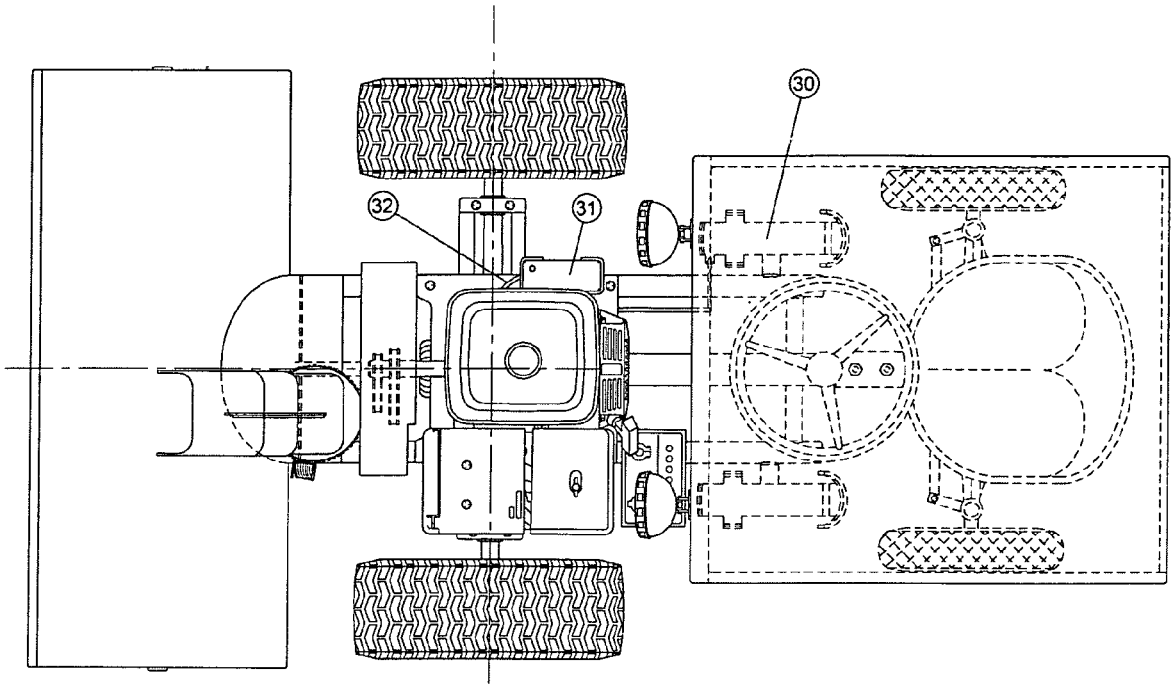
FIG. 3 shows a top view of an exemplary ride-on snow blower, in accordance with an embodiment of the present invention.

FIG. 3 shows a top view of an exemplary ride-on snow blower, in accordance with an embodiment of the present invention. In the present embodiment, a drive pedal 30 is linked to a hydrostatic trans-axle 41, shown by way of example in FIG. 5A, by a hydrostatic trans-axle input linkage, as shown by way of example in FIG. 4. Depressing the front portion of drive pedal 30 causes the vehicle to move forward, and depressing the rear portion of drive pedal 30 causes the vehicle to move in reverse. Releasing drive pedal 30 returns hydrostatic trans-axle 41 to a neutral position. Hydrostatic trans-axle reserve tanks 31 contain supplementary axle oil and allow for enhanced cooling of axle oil, and a reserve tank hose 32 links the front of hydrostatic trans-axle 41 to reserve tanks 31.

Figure 4:
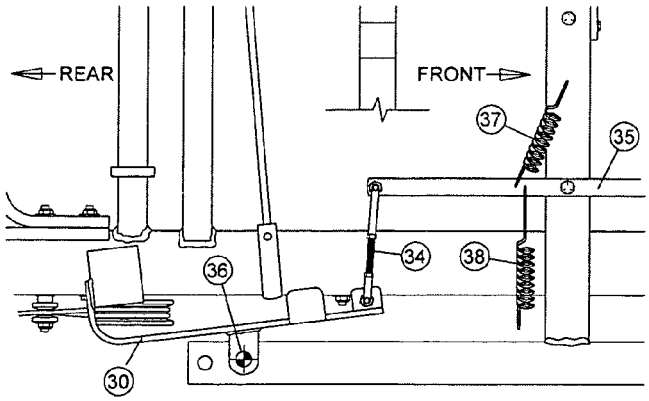
FIG. 4 shows a side view of an exemplary drive pedal mechanism from an exemplary ride-on snow blower, in accordance with an embodiment of the present invention.

FIG. 4 shows a side view of an exemplary drive pedal mechanism from an exemplary ride-on snow blower, in accordance with an embodiment of the present invention. In the present embodiment, drive pedal 30 is coupled to an adjustable drive linkage 34. Adjustable drive linkage 34 allows the fine-tuning of the operation of the linkage between drive pedal 30 and hydrostatic trans-axle 41, shown by way of example in FIG. 5A. An axle linkage 35 connected to hydrostatic trans-axle 41 transmits the motion of drive pedal 30 to the hydrostatic trans-axle input linkage. In the present embodiment, drive pedal 30 is connected to the vehicle by a pivot point 36 that allows drive pedal 30 to be depressed into a forward or backward position. A forward return spring 37 returns drive pedal 30 to a neutral position after being in the forward position, and a reverse return spring 38 returns drive pedal 30 to a neutral position after being in the reverse position.

Figure 5B:
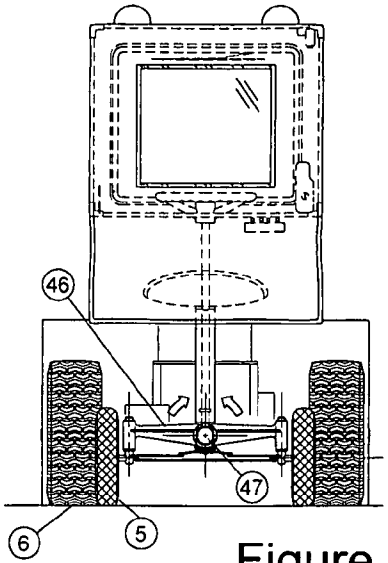
FIGS. 5A and 5B show an exemplary steering system on an exemplary ride-on snow blower, in accordance with an embodiment of the present invention.
Figure 5A:
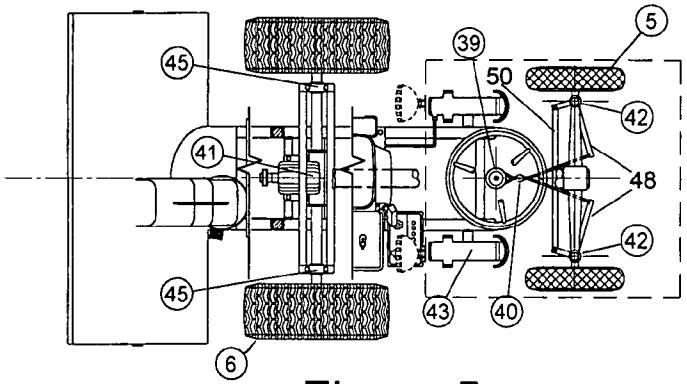

FIGS. 5A and 5B show an exemplary steering system on an exemplary ride-on snow blower, in accordance with an embodiment of the present invention. FIG. 5A shows a top view, and FIG. 5B shows a rear view. In the present embodiment, a steering column pulley 39, part of steering pulley system 13 shown by way of example in FIG. 1, is coupled to a steering crossover pulley 40. Cables in steering crossover pulley 40 are crossed to transmit the proper movement to steering knuckles 42. In the present embodiment, hydrostatic trans-axle 41 allows simple operation of the drive system. Constant input from motor 2, shown by way of example in FIGS. 1 and 6, activates an internal oil pump in hydrostatic trans-axle 41, which transmits movement to front wheels 6 through internal hydraulic motors. It should be noted that in the present embodiment the front wheels are each provided with their own respective drive axles; that is, a left drive ale (connected to the left-front wheel) and a right drive axle (connected to the right-front wheel) are the axles in question. These two front drive axles are preferably not locked together so as to enable differential action virtue of both axles being not locked together. This approach generally enables relatively smooth operation of the vehicle without shifting.

In the present embodiment, the steering is done by rear wheels 5, which, because rear wheels 5 are close together, allows a tight turning radius. Steering is transmitted from steering column pulley 39 to steering knuckles 42 by the cables in steering crossover pulley 40. These cables are attached to steering arms 48, which, along with a tire rod 50, transfer the motion to steering knuckles 42. Steering knuckles 42 also allow for adequate ground clearance. A rear axle 46 connects both rear steering knuckles 42 to the rear section of the frame. In the present embodiment, rear axle 46 can pivot around the center point of rear axle 46 at a rear axle pivot point 47 to allow for smooth operation on rough or wavy terrain. The present embodiment also has an auger lift pedal 43, which is described in more detail in conjunction with FIG. 6.

Figure 6:
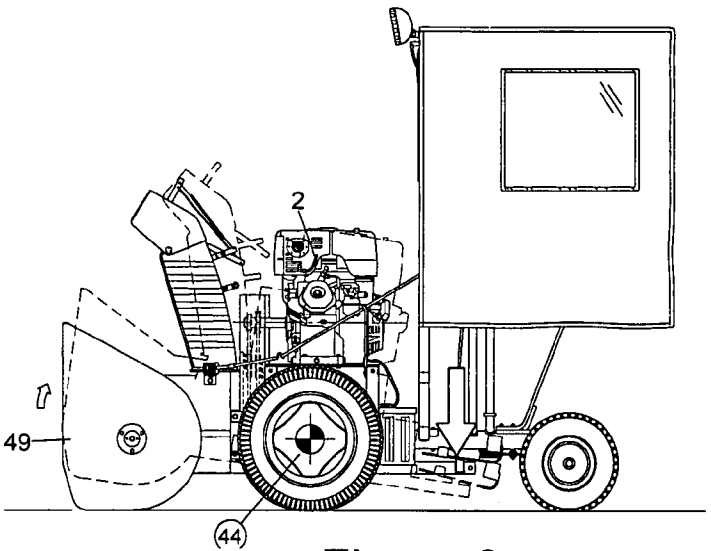
FIG. 6 shows a side view of an exemplary ride-on snow blower detailing an exemplary method of operation of an auger mechanism, in accordance with an embodiment of the present invention.

FIG. 6 shows a side view of an exemplary ride-on snow blower detailing an exemplary method of operation of an auger mechanism 49, in accordance with an embodiment of the present invention. Auger lift pedal 43, shown by way of example in FIG. 5A, is mounted to the front section of the frame, which can rotate independently from the rear cab section of the frame. This movement allows the lifting of auger mechanism 49 to keep auger mechanism 49 out of the way when the operator is driving the vehicle and auger mechanism 49 is not being used. By depressing auger lift pedal 43, the front section of the vehicle, including auger mechanism 49 and motor 2, pivots around an auger lift pivot point 44, which is also the front axle of the vehicle. Bearings 45, shown by way of example in FIG. 5A, are mounted on the front axle and to the auger frame section to comprise the pivot mechanism at auger lift pivot point 44. Once auger mechanism 49 is lifted into place, auger mechanism 49 can be locked into position, and released when desired.

In alternate embodiments the rear steering system may comprise a single wheel. In another alternate embodiment, auger mechanism 49 may be lifted by hydraulic means instead of mechanical means. In yet another embodiment, a zero-turn, ride-on lawn mower may be modified with a blower attachment adapted to the front portion of the lawn mower.

Having fully described at least one embodiment of the present invention, other equivalent or alternative ride-on snow blowers according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. A ride-on snow blower apparatus comprising:

a snow chute operable for flexible snow disposal, said snow chute having an adjustable pitch and orientation;

a motor;

means for controlling the power output of said motor;

means in corporation with said motor for transporting snow to said snow chute;

means for controllably powering and lifting said snow transporting means;

front wheels located in general to said motor;

rear wheels located under where the rider sits to operate said snow blower, said rear wheels being supported by at least one axle structurally joined to a frame of said snow blower, said rear wheels having a wheelbase substantially less than a wheelbase of said front wheels;

means for steering said snow blower in a desired direction;

means in corporation with said motor for controllably powering the locomotion of said snow blower in said desired direction; and a power source to power electrical components of said snow blower.

2. The ride-on snow blower of claim 1, further comprising means for adjusting the pitch and/or orientation of said snow chute.

3. The ride-on snow blower of claim 1, further comprising means for protecting surrounding equipment from interfering with said powering means of said snow blower.

4. The ride-on snow blower of claim 1, in which said rear wheels are disposed relatively close to the centerline of said snow blower where a width of said wheelbase of said rear wheels is substantially less than a width of said snow transporting means, said rear wheels thereby being operable to enable easy turning and to stay out of snow during turns.

5. The ride-on snow blower of claim 1, in which said snow transporting means powering means comprises a hydrostatic trans-axle unit, which unit transmits movement to said front wheels through internal hydraulic motors that receiver constant power input from said motor.

6. The ride-on snow blower of claim 1, further comprising means for enabling differential axle action in said snow blower thereby facilitating smooth operation of said snow blower without shifting.

7. The ride-on snow blower of claim 1, further comprising means for enabling said at least one rear axle to pivot around the center point of said at least one rear axle to thereby improve smooth operation on rough or wavy terrain.

8. The ride-on snow blower of claim 1, further comprising means for keeping said snow transporting means from hindering normal driving operation of said snow blower when said snow transporting means is not being used.

9. The ride-on snow blower of claim 1, in which said motor is an electric motor.

10. The ride-on snow blower of claim 1, in which said motor is a gasoline powered combustion engine.

11. The ride-on snow blower of claim 1, further comprising cab means for housing and protecting a rider of said snow blower from the elements.

12. The ride-on snow blower of claim 11, further comprising means for the rider to sit down in said cab means.

13. The ride-on snow blower of claim 11, further comprising means configured with said cab means for protecting the rider from injury and for providing a sturdy mounting location for electrical accessory equipment.

14. The ride-on snow blower of claim 11, further comprising means for gaining access to said cab means.

15. The ride-on snow blower of claim 11, further comprising means for viewing outside said cab means from inside.

16. The ride-on snow blower of claim 11, further comprising means for mounting lights.

* * * * *